US009759025B2

(12) United States Patent
Vavik

(10) Patent No.: US 9,759,025 B2
(45) Date of Patent: Sep. 12, 2017

(54) METHOD FOR DETECTING WELLBORE INFLUX

(71) Applicant: MHWIRTH AS, Kristiansand (NO)

(72) Inventor: Dag Vavik, Trondheim (NO)

(73) Assignee: MHWIRTH AS, Kristiansand (NO)

( * ) Notice: Subject to any disclaimer, the term of this patent is extended or adjusted under 35 U.S.C. 154(b) by 0 days.

(21) Appl. No.: 15/317,120

(22) PCT Filed: May 20, 2015

(86) PCT No.: PCT/NO2015/050084

§ 371 (c)(1),
(2) Date: Dec. 8, 2016

(87) PCT Pub. No.: WO2015/190932

PCT Pub. Date: Dec. 17, 2015

(65) Prior Publication Data

US 2017/0122046 A1 May 4, 2017

(30) Foreign Application Priority Data

Jun. 10, 2014 (NO) ..... 20140718

(51) Int. Cl.
*E21B 7/12* (2006.01)
*E21B 21/00* (2006.01)
(Continued)

(52) U.S. Cl.
CPC ..... *E21B 21/001* (2013.01); *E21B 7/12* (2013.01); *E21B 44/00* (2013.01); *E21B 47/06* (2013.01);
(Continued)

(58) Field of Classification Search
CPC ..... E21B 7/12; E21B 21/001; E21B 21/067; E21B 44/00; E21B 47/06; E21B 47/065
See application file for complete search history.

(56) References Cited

U.S. PATENT DOCUMENTS 4,733,233 A 3/1988 Grosso et al.
5,006,845 A * 4/1991 Calcar ..... E21B 21/001 166/336

(Continued)

FOREIGN PATENT DOCUMENTS

EP 2 417 432 A1 2/2012
WO WO 2010/118342 A1 10/2010
WO WO 2013/055706 A1 4/2013

*Primary Examiner* — Matthew R Buck
(74) *Attorney, Agent, or Firm* — Norman B. Thot

(57) ABSTRACT

A method for detecting an influx in a wellbore with first and second pressure transmitters arranged in a fixed vertical distance in relation to each other. The method includes calculating an expected density of a return flow between the first and second pressure transmitters, continuously measuring an actual density of the return flow based on a measured pressure at the first and second pressure transmitters, comparing the calculated expected density of the return flow and the measured actual density of the return flow to determine the influx in the wellbore, and predicting a probability of hydrates forming in the well by measuring a temperature via a temperature transmitter arranged in a section of the well adjacent to the first and/or the second pressure transmitter, and using the temperature together with the measurements from the first and second pressure transmitters.

21 Claims, 6 Drawing Sheets

(51) Int. Cl.

| | |
|---|---|
| ***E21B 44/00*** | (2006.01) |
| ***E21B 47/06*** | (2012.01) |
| *E21B 33/064* | (2006.01) |
| *E21B 21/06* | (2006.01) |

(52) U.S. Cl.
CPC ..... *E21B 47/065* (2013.01); *E21B 21/067* (2013.01); *E21B 33/064* (2013.01)

(56) References Cited

U.S. PATENT DOCUMENTS

| | | | | |
|---|---|---|---|---|
| 6,668,943 | B1 * | 12/2003 | Maus | E21B 21/001 175/212 |
| 8,517,111 | B2 * | 8/2013 | Mix | E21B 21/001 166/250.01 |
| 2004/0065477 | A1 | 4/2004 | Paulk et al. | |
| 2012/0085544 | A1 | 4/2012 | Shilling et al. | |
| 2012/0170610 | A1 | 7/2012 | Ramos et al. | |
| 2013/0087388 | A1 * | 4/2013 | Veeningen | E21B 47/10 175/48 |
| 2013/0090855 | A1 * | 4/2013 | Rasmus | E21B 47/06 702/9 |
| 2015/0211362 | A1 * | 7/2015 | Rogers | E21B 47/06 73/152.22 |

* cited by examiner

METHOD FOR DETECTING WELLBORE INFLUX

CROSS REFERENCE TO PRIOR APPLICATIONS

This application is a U.S. National Phase application under 35 U.S.C. §371 of International Application No. PCT/NO2015/050084, filed on May 20, 2015 and which claims benefit to Norwegian Patent Application No. 20140718, filed on Jun. 10, 2014. The International Application was published in English on Dec. 17, 2015 as WO 2015/190932 A1 under PCT Article 21(2).

FIELD

The present invention relates to a method for early detection of a wellbore influx.

BACKGROUND

Present enhanced kick detection systems in use have been based on advanced flow measurements such as Coriolis meter and to keep control over total active volume and rate of penetration (ROP). However, to create a kick detection system that rely on changes in volume flow has shown to be difficult since the expansion of the gas, and hence rapid change in volume flow or gain, typically occurs 800 to 1000 meter below sea surface and in large water depths, as this will be too late since the gas has then already passed the subsea BOP.

Hydrates may also form if the pressure is high and temperature low enough, making early kick detection based on volume control almost impossible. This is due to the fact that when hydrates have been formed, the gas or hydrates will not expand until the hydrates "melt". The gas molecules are "trapped and/or hidden" within a crystal structure of water molecules, and will be transported like a "trojan horse", up the wellbore and high up the drilling riser. When the pressure is low enough, and the hydrates have been transported high up in the riser, the gas will be released and will expand rapidly, see details in FIG. 1.

Severe circulation losses are often encountered when drilling naturally fractured formations, particularly carbonate (limestone, dolomite, etc.). Lost circulation and losses are also encountered when drilling in highly depleted reservoirs where the fraction pressure in the pay zone may be lower than the pore pressure in the overlying layers. The same phenomenon is also encountered when drilling in some special areas such as the "Pre-salt" layers outside Brazil, in particular in the gouge zones below the salt and other naturally fractured and unconsolidated formations. In conjunction with drilling in these types of formations, a special type of Managed Pressure Drilling (MPD) called "Mud Cap Drilling" is used to overcome the challenge with a sudden drop in pore and fraction pressure. A sacrificial fluid (often water) is pumped through the drill string and lost to the formation while the annulus is filled from the top, typically with a light mud (LAM, Light Annular Mud). In these situations, gas kick from a high pressure overlying layer, can happen simultaneously with lost circulation in the low pressure zone. Hydrocarbon influx may also be caused by swap out (no gain or loss observed) as light hydrocarbons are displaced with the more heavier drilling fluid. Kick detection based on volume control (gain/loss) is therefore a challenge. To avoid that the gas migrates up the annulus, LAM will be pumped down the annulus at a greater speed then the gas migration velocity to "bullhead" any potential gas back into a lower pressure zone. As any potential gas influx are bullheaded down and mix with the relative cold sacrificial fluid (water), hydrates may form, making kick detection based on traditional method such as volume control and "flow check" impossible. When hydrates form, the displaced volume of the influx is reduced by approximately 50%. This means that gas influx behavior when the well is shut-in will be observed different from what is expected. When dense gas and water form, the total volume is reduced and the density increases. Hence the observed loss of drilling fluid may be an indication of hydrocarbon influx. This phenomenon can also be observed as slight reductions of shut-in pressure over the time period were hydrates are forming. If hydrates have already formed, it is difficult to detect because the hydrates will have almost the same density as the water it has replaced, and the well can incorrectly be interpreted as "dead", because the well may not flow or shut-in pressure will not increase.

Other early gas detection systems have also been tried out based on Measurement While Drilling (MWD) based on different physical properties between mud and influx. In one such system the measurements are based on the fact that a pressure pulse (or sound waves) have a different speed depending on whether the pulse travels through mud, water, oil or gas and this can be registered in a sudden change or variation in phase and/or amplitude of the pressure wave (pulse). However, since the gas is in dense phase at the time of influx, it will form an almost perfect homogeneous fluid and mix easily with the mud. Especially with oil based mud, because some of the base oils in use have similar physical properties as the influx in dense phase.

Other early kick detection systems have been based on the different physical properties between mud (mud base fluid) and influx. Documents U.S. Pat. No. 4,733,233 A and EP 2.417.432 A1 are examples of this. The challenge in these solutions is that the influx tends to form a homogeneous mixture with the mud base fluids. Additionally, under high pressure, the density difference etc. between the influx and the base fluids are not so large (especially with oil based mud), and the difference is therefore hard to detect. An analogue to this is that it is hard to detect your $CO_2$ "bubbles" in a bottle of champagne before you release the pressure by opening the bottle.

WO 2013/055706 A1 focus on the change in density or pressure and states that if the annular pressure gradient decreases, then you have a wellbore influx (compare FIG. 5 in said publication). However, this is not always true due to the fact that as the influx travels up the annulus the gas expansion (and hence change in density) is very small under the high pressure typically present deep down in the well. As the influx is further cooled down when it reaches the colder annulus fluid in the wellhead and riser (especially in deep water), the gas may react with water and form hydrates resulting in that the measured pressure and density will increase rather than decrease, see FIG. 1. Additionally, a decrease in density may result from a number of other reasons, such as a reduction in cuttings content in the annulus due to low or now rate of penetration (ROP), giving a "false alarm" even if influx is not actually present.

In US 2013/0090855 A1 a method for computing a density of an inflow constituent is claimed. The method evaluates the density of the inflow constituent computed to identify the inflow constituent (i.e., gaseous, oil or water). However the disclosure does not consider the risk of hydrates forming in the wellbore. Such hydrates formed in the wellbore are difficult to detect because the hydrates will have almost the same density as the water it has replaced, and the density of the inflow constituent computed may have almost the same density as wellbore annulus constituent prior to the influx.

SUMMARY

An aspect of the present invention is to overcome the shortcoming of previous early kick detection systems which are based on flow control and gas expansion, as well as to prevent "false alarm" of influxes which are actually not present. Another aspect of the present invention is to provide guidelines for correct remedial action to be taken to avoid incidents with hydrate plugs.

In an embodiment, the present invention provides a method for detecting an influx in a wellbore with at least one first pressure transmitter arranged in a first position in a well and at least one second pressure transmitter arranged in a second position in the well, the at least one first pressure transmitter and the at least one second pressure transmitter being arranged in a fixed vertical distance in relation to each other. The method includes calculating an expected density of a return flow between the at least one first pressure transmitter and the at least one second pressure transmitter by measuring or predicting a mud or sacrificial fluids density, a rock density, a first flow rate, a true vertical depth, a rate of penetration, and a wellbore diameter; continuously measuring an actual density of the return flow based on a measured pressure at each of the at least one first pressure transmitter and the at least one second pressure transmitter, the actual density being computed based on a vertical distance between the at least one first pressure transmitter and the at least one second pressure transmitter as adjusted for a frictional pressure drop between each of the at least one first pressure transmitter and the at least one second pressure transmitter based on a direction and a second flow rate in an annulus in the wellbore; comparing the calculated expected density of the return flow and the measured actual density of the return flow to determine the influx in the wellbore; and predicting a probability of hydrates forming in the well by using at least one first temperature transmitter arranged in a section of the well adjacent to the at least one first pressure transmitter and/or adjacent to the at least one second pressure transmitter, measuring a temperature at the at least one first temperature transmitter, and using the temperature together with the measurements from the at least one first pressure transmitter and the at least one second pressure transmitters.

BRIEF DESCRIPTION OF THE DRAWINGS

The present invention is described in greater detail below on the basis of embodiments and of the drawings in which.

DETAILED DESCRIPTION

Figure 1:
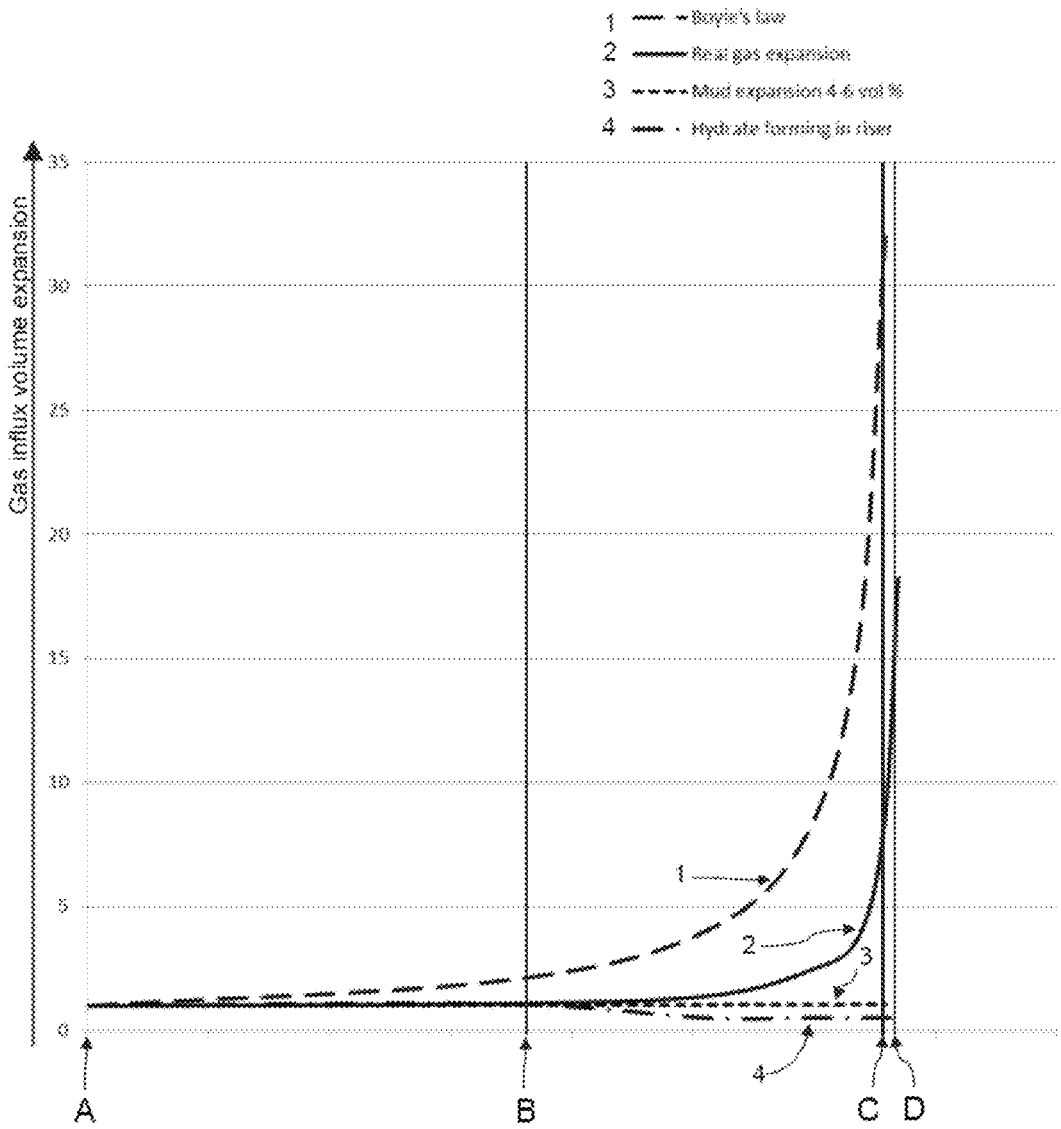
FIG. 1 is a schematic showing the gas influx volume expansion as it travels up the wellbore and riser.

The present invention relates to a method of early detection of a wellbore influx by comparing calculated expected wellbore annulus density based on ROP, estimated rock density and mud density and comparing this with actual downhole measured density, in a "Fuzzy logic" control system, in order to prevent "false alarm" of influxes which are actually not present.

Typical densities are given below:

Rock density is typically in the order of 2.2-2.8 Specific Gravity (SG).

Base Oil (OBM) has typically a specific gravity SG of 0.78-0.86 depending of type.

Water (WBM) has a typically specific gravity SG of 1 and a little higher if salt is present.

Influx with will typically have a specific gravity SG of 0.25-0.5, depending of reservoir pressure (P), temperature (T) and gas content.

The main difference between prior art and the present invention is that in the present invention the difference in physical properties between the influx and the solid rock density is measured/calculated, while in prior art it is focused on changes of the physical properties of the drilling fluid only.

The density of the mix of cuttings and oil based mud/water based mud ($\rho_{Calc}$) returning in the wellbore annulus (the return flow) will depend on flow rate ($Q_{In}$), mud density ($\rho_{mud}$), rate of penetration (ROP), diameter of the drilled well bore ($D_{Well}$) and rock density ($\rho_{Rock}$), given in the formula below:

$$\rho_{Calc} = \frac{Q_{In}\rho_{Mud} + 0.25\pi D_{Well}^2 ROP \rho_{Rock}}{Q_{In} + 0.25\pi D_{Well}^2 ROP}$$

This formula is used, according to the present invention, for calculation of an expected density for the return flow and is compared with the measured actual return flow density. The measured actual return flow density is calculated/measured by in-situ pressure measurements with pressure transmitters arranged at different locations in the well, i.e., if the pressure in the annulus is monitored using pressure transmitter as part of a Measurement While Drilling (MWD) tool, the actual mud density ($\rho_{Mud}$) can be calculated based on true vertical depth (TVD) at the location of the pressure transmitter(s) and be compared with the theoretical or expected density for the return flow ($\rho_{Calc}$) calculated by the formula above.

However, with only one pressure transmitter ($P_1$) down at the well, the system will respond slow to changes in the overall mud density ($\rho_{mud}$) in the annulus since the overall $\rho_{mud}$ will depend on the total volume and also change higher up in the annulus. Especially in the riser annulus where the diameter are larger and often booster mud are introduced in the annulus in addition to the cuttings and mud coming from the well.

In case of mud cap drilling, the present invention should be based on fluid pumped down the annulus taken into account that cuttings and fluid is pumped into the formation.

The preferred solution will therefore be to add a second pressure transmitter in a distance (h) higher up in the well, e.g., on the drill string or in the casing wall, wired etc. Then the true density of the return flow ($\rho_{mud}$) can be calculated based on true vertical distance between the two pressure transmitters ($P_1$) and ($P_2$).

When calculating the true density of the return flow ($\rho_{mud}$) based on the first pressure transmitter ($P_1$) and the second pressure transmitter ($P_2$), correction should be made for differential pressure ($\Delta P$) due to friction and angle on the drill pipe in case of directional drilling.

In an aspect of the present invention, pressure transmitters ($P_1$, $P_2$) may be located on the drill string using MWD tools. However, this will not detect kicks that may enter the well higher up in the well, below the last/lowest casing. This is important in a kick/loss scenario where equivalent circulating density (ECD) is lowered in order to limit the loss of mud in the lower section of the well simultaneously as kicks enter the wellbore from a high pressure zone higher up in the well. A better alternative is to install pressure transmitter ($P_1$, . . . , $P_n$) with fixed vertical distance in the casing, alternative with multiple sensors along the drill string. This will also allow the migration of the kick to be followed after the circulation has stopped.

The present invention relates to a method for early detection of a wellbore influx using at least a first pressure transmitter ($P_1$) arranged in a first position in the well and a second pressure transmitter ($P_2$) arranged in a second position in the well, the at least first and second pressure transmitters ($P_1$, $P_2$) being arranged in a fixed vertical distance in relation to each other, the method comprising the steps:

A) calculating an expected density of a return flow between the at least first and second pressure transmitters ($P_1$, $P_2$) by measuring or predicting mud or sacrificial fluids density, rock density, flow rate ($Q_{In}$), true vertical depth (TVD), rate of penetration (ROP) and wellbore diameter ($D_{Well}$), B) continuous measuring of the actual density of a return flow based on a measured pressure at each of the at least first and second pressure transmitters ($P_1$, $P_2$), the actual density being computed based on vertical distance (h) between the first and second pressure transmitters ($P_1$, $P_2$) and adjusted for frictional pressure drop between each of the at least first and second pressure transmitters ($P_1$, $P_2$) based on direction and the flow rate (Q) in annulus, and C) comparing the calculated expected return flow density and the measured actual return flow density to determine a wellbore influx, and D) by means of at least a first temperature transmitter ($T_1$) arranged in a section of the well adjacent the at least first and/or second pressure transmitter ($P_1$, $P_2$), measuring the temperature at the at least first temperature transmitter ($T_1$), and using said temperature together with the measurements from the first and second pressure transmitters ($P_1$, $P_2$) to predict the probability of hydrates forming in the well.

The at least first and second pressure transmitters ($P_1$, $P_2$) can be arranged in an open-hole section of the well.

The at least first temperature transmitter ($T_1$) may be arranged in an open-hole section of the well.

In an aspect of the method one may use a plurality of pressure transmitters ($P_1$, $P_2$, . . . , $P_n$) in fixed vertical distance in the well, and wherein the method further may comprise repeating steps A), B) and C) between two adjacent pressure transmitters ($P_1$, $P_2$, . . . , $P_n$).

In an aspect, the method according to the present invention may further comprise a step E)—to confirm a wellbore influx if the measured actual return flow density is significantly less than the calculated expected return flow density.

The method according to the present invention may further comprise monitoring possible rapid gas expansion in the well and automatically regulate a riser gas handling (RGH) or managed pressure drilling (MPD) choke by a constant value of applied surface back pressure ($P_{ASBP}$), and, if high risk of hydrates, setting the applied surface back pressure $P_{ASBP}$ as low as possible and inject hydrate inhibitor below a rotating control device (RCD).

In an aspect of the method according to the present invention, the method may further comprise the step of:

always displacing the riser if temperature in riser is below hydrate formation temperature $T_{Hyd}$, pumping fresh mud down at least one booster line and circulating out gas cut mud, monitoring possible rapid gas expansion (as hydrates "melt" at low pressure), be prepared to divert overboard to avoid "riser blow-out" on drill floor.

The method according to the present invention may further comprise, in case the wellbore influx has inadvertently passed a subsea blowout preventer (BOP), pumping mud down at least one booster line and circulating out gas cut mud, and monitoring possible rapid gas expansion and be prepared to divert overboard to avoid "riser blow-out" on drill floor.

The method according to the present invention may further comprise to use a plurality of temperature transmitters ($T_1$, . . . , $T_n$) adjacent any pressure transmitter ($P_1$, $P_2$, . . . , $P_n$) in the well, the method further comprises using readings from said temperature transmitters ($T_1$, . . . , $T_n$) together with the measurements from the first and second pressure transmitters ($P_1$, $P_2$) to predict the probability of hydrates forming in the well.

In an aspect, the method according to the present invention may further comprise a step F)—to confirm a possible hydrate formation, and generating a warning if the temperature ($T_1$, . . . , $T_n$) is less than, or lower than, a predefined safety margin to the corresponding hydrate formation temperature $T_{Hyd}$.

The method according to the present invention may further comprise the steps of filling at least one kill line with hydrate inhibitor fluid, injecting said hydrate inhibitor fluid present in the at least one kill line in the blow out preventer (BOP), and, simultaneously pumping fresh mud down the drill string to circulate out the wellbore fluids and inhibitor up at least one choke line and divert to a mud gas separator.

In an aspect, the method according to the present invention may further comprise a step G)—deciding that a choke line shut-in pressure ($P_c$) is showing abnormal pressure decrease, and generate a wellbore influx and hydrate alarm.

The method according to the present invention may further comprise a step H)—identifying a stuck pipe situation as a possible result of hydrate formation by observing increased drag trend or torque oscillation during connections and/or abnormal pressure increase or pressure oscillation during circulation, and confirming that all of the following conditions are fulfilled:

drilling in a permeable formation, which permeable formation is identified to have the ability to act as a reservoir rock as well as having a pressure close to or higher than a bottom hole pressure or measured pressure at a pressure transmitter ($P_1$-$P_n$) in the well, observing that the temperature in the wellbore is below hydrate formation temperature $T_{Hyd}$, observing circulation restriction or pressure peak.

In an aspect of the method, in case of a stuck pipe situation caused by hydrate formation, the method may further comprise the steps of:

injecting hydrate inhibitor fluid close to a wellhead, stop circulation allowing the temperature in the formation to increase the temperature of the fluids in the well thereby melting or dissociating the hydrates into water and dense gas, perform flow check to verify hydrate dissociation process has started, shut-in the well if well starts to flow and monitor shut-in pressure increase to determine size of hydrate plug/kick.

These and other characteristics of the present invention will be clear from the following description of a preferential form of embodiment, given as a non-restrictive example, with reference to the attached drawings wherein:

FIG. 1 shows how a specific volume of gas influx will expand as it travels up the wellbore and riser towards a floating drilling unit, e.g., a rig. The X-axis indicates travel distance, or more correctly pressure reduction, as the influx travels from bottom of the wellbore where influx may enter the wellbore at a position A, to the floating drilling unit at a position D. The pressure used in the simulated gas influx at position A is 1000 bara. Position B indicates the seabed and the subsea BOP located at 3000 meter water depth, where the pressure is reduced to 500 bara due to reduction of static column of mud with specific gravity SG1,5 (p=1500 kg/m3). Position C is in the drilling riser annulus 100 meters below sea level, where the pressure is reduced to 31 bara. Position D is onboard the drilling unit upstream a managed pressure drilling (MPD) choke, where the pressure is approximately 16 bara. Boyle's law (line 1) says that when the pressure of a gas is reduced by 50% the volume will expand by 100%. In other words, if the pressure is reduced from 1000 bara (position A) to 500 bara (position B), the volume should increase from 1.0 $m^3$ to 2.0 $m^3$, according to Boyle's law (line 1). However, under these high pressures currently experienced in deep water, the natural gas influx will be in dense phase and have a density behavior similar to a liquid. The real gas expansion (line 2) below the subsea blow out preventer BOP located at seabed at position B is insignificantly higher than the mud expansion (line 3). For this reason early kick detection based on changes in density or volume, as the undetected kick travels up the wellbore will not work. In deep water it is also another challenge that the annulus fluid in the wellhead, subsea blow out preventer BOP and lower part of the riser has a temperature that often are well below the temperature where hydrates form ($T_{Hyd}$). When the gas influx then reaches the wellhead at the position B, it will be cooled by the cold surrounding seawater and hydrates may form in the riser (line 4). For kick detection based on gas expansion (line 2), this will be catastrophic, because when hydrates are forming in the riser (line 4), the total volume will decrease rather than increase. When the hydrates is transported to upper part of the riser (position C), they may dissociate (melt) into water and gas as the pressure in the riser get lower, causing a rapid gas expansion. However, the dissociation time (how rapid the hydrates melt) is very uncertain, and depends on many factors. The most important factor is how much applied surface back pressure ($P_{ASBP}$) that the riser annulus will see upstream the MPD choke (position D). In the worst case scenario the hydrate dissociation time will be so long that there is a risk that outlets from the drilling and top of the riser plug up with hydrates before the hydrates dissociate when the riser is equipped with MPD or riser gas handling (RGH) choke (MPD/RGH choke) capable of applying back pressure to the riser annulus. For conventional drilling with atmospheric riser and conventional flow line, a rapid gas expansion associated with hydrates dissociate in the upper part of the riser, with a possible gas and mud "blow-out" on drill floor or through the diverter system most likely is to be the scenario. This shows how important it is to have an early kick detection system that works, to ensure that wellbore influx is detected before it get passed the wellhead and the subsea blow out preventer BOP at position B.

Figure 2:
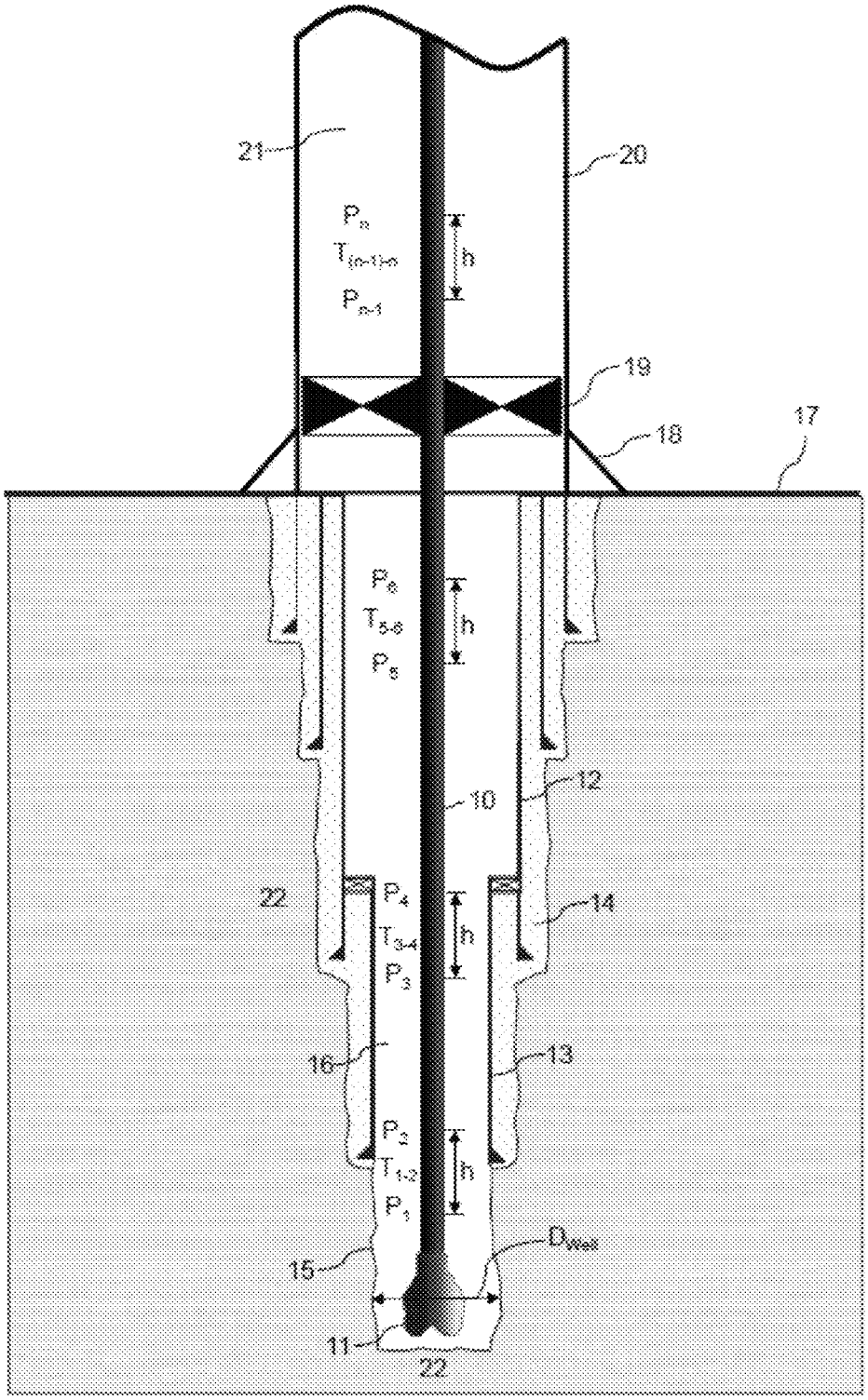
FIG. 2 is a simplified schematic of a subterranean well and drilling riser showing multiple sensors for transmitting downhole information, such as pressure and temperature, to a floating drilling unit.

FIG. 2 shows a simplified schematic of a subterranean well and lower part of a drilling riser 20. A well is cased with casing 12 in the upper part and a liner 13 in the middle part, which are cemented 14 to an earth formation 22. A lower part of the well is an open-hole section 15, with a diameter $D_{Well}$. A drill string 10 extends from the top of the riser 20 to the bottom of the well having a drill bit 11 in its lowermost end, for drilling into the earth formation 22. Drilling fluids flow on the inside of the drill string 10, down to the drill bit 11 and flows back up towards the surface in the annulus 16 formed between the drill string 10 and the formation 22, liner 13 or the casing 12. A larger annulus 21 is formed between the drill string 10 and the marine drilling riser 20. A first pressure transmitter $P_1$ is arranged in the open hole section 15. A second pressure transmitter $P_2$ is arranged above the first pressure transmitter $P_1$ in a fixed vertical distance h. At least a first temperature transmitter $T_{1-2}$ is arranged between or close to the pressure transmitters $P_1$ and $P_2$. A plurality of pressure transmitter sets ($P_1$-$P_2$), ($P_3$-$P_4$) . . . , ($P_{n-1}$-$P_n$) in fixed vertical distance h in the well is arranged in order to measure and transmit downhole annulus density. Likewise, a plurality of temperature transmitters $T_{1-2}$, $T_{3-4}$, . . . $T_{(n-1)-n}$ is arranged close to the pressure transmitter sets ($P_1$-$P_2$), ($P_3$-$P_4$) . . . , ($P_{n-1}$-$P_n$). Above the sea bed 17 a wellhead 18 and a subsea BOP 19 is connected to the marine drilling riser 20.

In the FIGS. 3-6, it is made reference to the specific boxes in the decision trees, i.e., the text and required actions identified in these boxes shall be considered as a part of this written detailed description. These Figures are self-explanatory.

Figure 3:
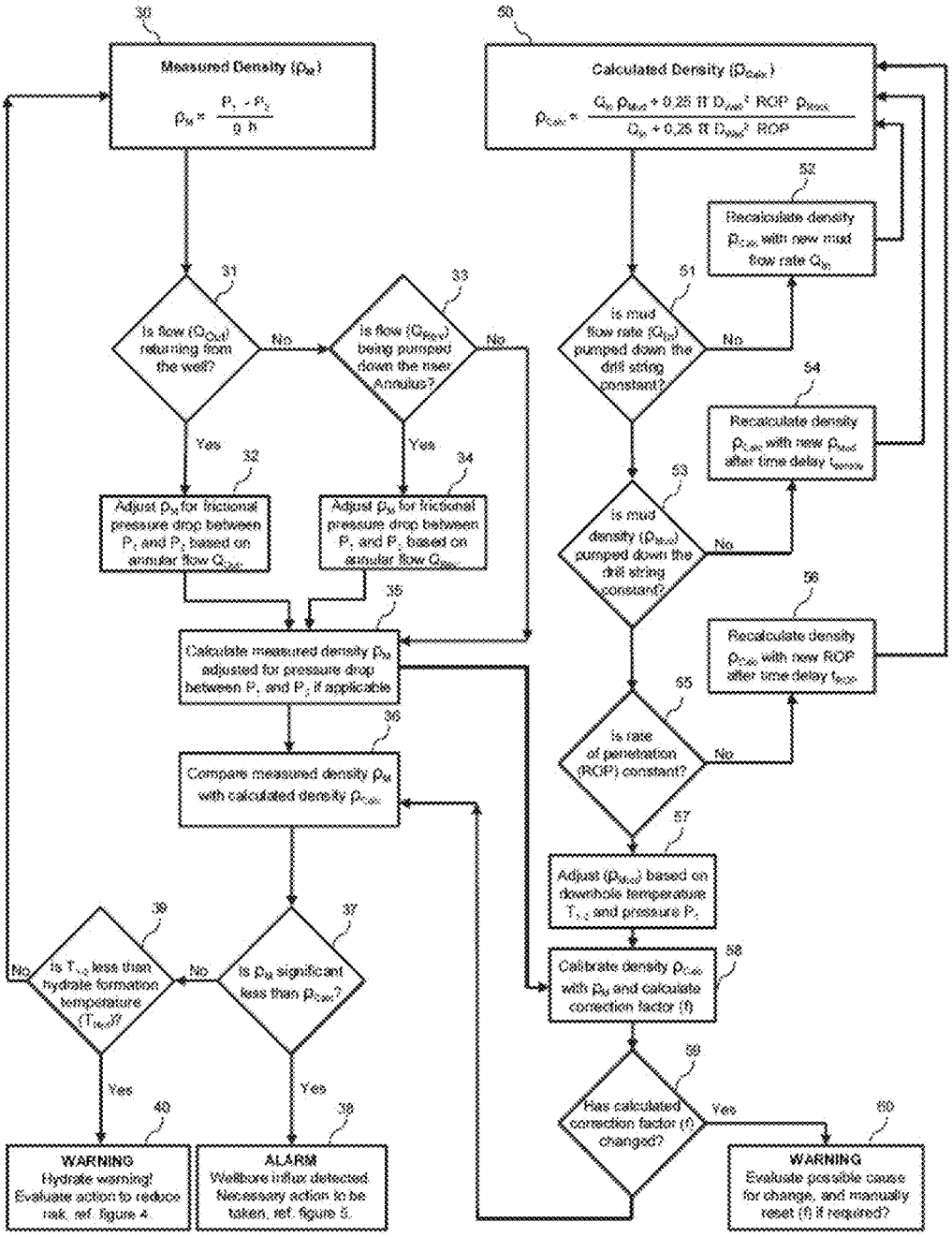
FIG. 3 discloses schematically an embodiment of a method according to the present invention.

FIG. 3 discloses schematically an embodiment of the present invention. Based on existing technology that can transmit downhole real time data, commonly named as measurement while drilling (MWD) tools, either wireless or by wired drill pipe or other solution for transmitting downhole measurements, the present invention utilize a new method for predicting wellbore influx. The measured downhole annulus fluid density (box 30), is calculated based on a fixed vertical distance h between two pressure transmitters $P_1$ and $P_2$, based on standard gravity given in SI units as 9,807 $m/s^2$. Note that if the present invention should be used for directional drilling the vertical distance h, needs to be corrected based on the angle of the drill pipe between the two pressure transmitters $P_1$ and $P_2$. During normal drilling operations drilled cuttings and mud is returning to the rig, and the measured density (box 30) needs to be adjusted for frictional pressure drop between pressure transmitters $P_1$ and $P_2$, based on annular flow $Q_{Out}$ (box 32). In some special cases when total loss is experienced, fluids may be pumped down the annulus in the opposite direction, typically used in pressurized mud cap drilling. In these cases the measured density (box 30) needs to be adjusted for frictional pressure drop between pressure transmitters $P_1$ and $P_2$ based on annular flow but in a reversed direction $Q_{Rev}$ (box 34). Then the measured density $\rho_M$ (box 30) can be calculated adjusted for pressure drop between pressure transmitters $P_1$ and $P_2$, if applicable (box 35).

The calculated density $\rho_{Calc}$ (box 50) is calculated based on the flow rate $Q_{In}$ being pumped down the drill string (box 51), the density $\rho_{Mud}$ pumped down the drill string (box 53) and rate of penetration (ROP) (box 55). In addition, an expected diameter of the well $D_{Well}$ and expected density of the formation $\rho_{Rock}$ is used to calculate the expected calculated density (box 50).

If the flow rate $Q_{In}$ being pumped down the drill string changes, the new calculated density $\rho_{Calc}$ has to be recalculated (box 52).

If the mud density $\rho_{Mud}$ pumped down the drill string changes, new calculated density $\rho_{Calc}$ has to be recalculated with new mud density $\rho_{Mud}$ after time delay $t_{density}$, (box 54). The time delay $t_{density}$ needs to be calculated based on the time mud takes to travel from the density meter located topside to the pressure transmitters $P_1$ and $P_2$ downhole in the annulus.

If the rate of penetration (ROP) changes, new calculated density $\rho_{Calc}$ has to be recalculated with new ROP after time delay $t_{ROP}$ (box 56). The time delay $t_{ROP}$ needs to be calculated based on the time mud and cuttings take to travel from the drilling bit 11 at the bottom of the wellbore to the pressure transmitter $P_1$ and $P_2$ in the annulus. Time delay $t_{density}$ and $t_{ROP}$ can be "tuned" based on real time measurements and experience during connection and change in mud density.

Since the mud density ($\rho_{Mud}$) is taken from close to atmospheric pressure, typically from a topside located density meter upstream the high pressure (HP) mud pumps, it should be adjusted based on downhole temperature $T_{1-2}$ and pressure $P_1$ (box 57). Mud density $\rho_{Mud}$ will typically increase with increased pressure. The compressibility will also depend on type of mud (OBM or WBM) and the water content. If the pressure measured at pressure transmitter $P_1$ is 1000 bara, the change in density will typically be in the order of 4 to 6% depending on type of mud being used.

Since the expected diameter of the well ($D_{well}$) and expected density of the formation $\rho_{Rock}$ is unknown, the calculated density $\rho_{Calc}$ (box 50) is calibrated with measured density $\rho_M$ (box 35) and a correction factor (f) is calculated (box 58). If the calculated correction factor (f) changes (box 59), a warning should be given to evaluate possible cause for change (box 60).

After all the correction has been done, the measured density $\rho_M$ is compared with the calculated density $\rho_{Calc}$ (box 36), if the difference is significant (box 37), a wellbore influx alarm will be given (box 38).

The downhole hydrate formation temperature $T_{Hyd}$ is calculated based on the actual pressure measured at the pressure transmitters $P_1$, $P_2$, $P_3$, $P_4$, $P_n$, $P_{n+1}$, etc. and checked against the corresponding real downhole temperature measured at the temperature transmitters $T_{1-2}$, etc. (box 39). If the temperature measured by the temperature transmitter $T_{1-2}$, etc. is less than hydrate formation temperature $T_{Hyd}$, then a hydrate warning will be given (box 40). The hydrate warning is given to alert an operator of the increased risk associated with drilling ahead with temperatures in the wellbore below the hydrate formation temperature $T_{Hyd}$, as will be more detailed described with reference to FIG. 4.

Figure 4:
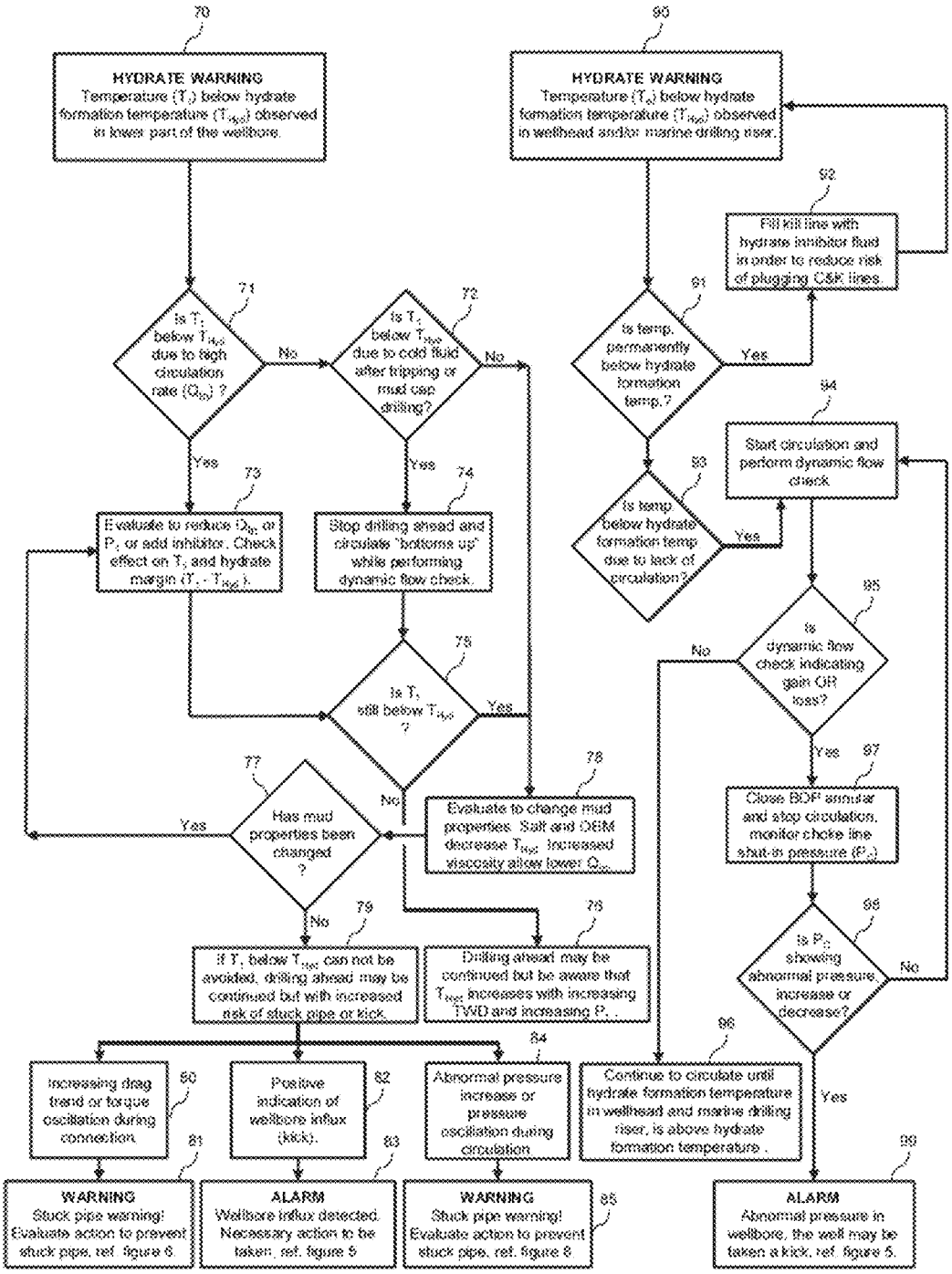
FIG. 4 discloses schematically a method for determine the correct remedial action to be taken based on a hydrate warning.

FIG. 4 shows schematically a method for determining the correct remedial action to be taken based on hydrate warning. In deep water it is not unusual to have low temperature below the hydrate formation temperature $T_{Hyd}$ in the wellhead, subsea BOP and lower part of the riser annulus (box 90). In these cases it is important that a dedicated chemical injection line or, if this is not available, the kill line can be used for injecting hydrate inhibitor (fluid), e.g., ethylene glycol (MEG). The amount of MEG required for hydrate suppression must be calculated based on mud type in use and ambient seawater temperature or, in worst case scenario, for annulus mud temperature. It is important that the chemical injection line (or kill line) is filled up with MEG prior to drilling in formation that potentially can give gas influx (box 92), since hydrates may form quickly and potentially plug the subsea BOP and choke line when the kick is circulated out through the kill and choke (K&C) manifold. It should also be noted that under normal drilling operation the fluid in the kill and choke lines will normally be stagnant (continuous circulation not possible) and the temperature is therefore permanently below the hydrate formation temperature $T_{Hyd}$ in these lines (box 91). Hydrate inhibitor for hydrate suppression is therefore required in these kill and choke lines to reduce risk of plugging the lines when they are used for circulating out gas in a kick scenario.

After longer periods without circulation in the wellbore annulus, typically after a casing cement job and/or tripping operation, it is not unusual for the fluid temperature in the wellhead annulus to drop below the hydrate formation temperature $T_{Hyd}$. Prior to drilling ahead a driller shall perform the following actions; Start circulation and perform dynamic flow check (box 94), is dynamic flow check indicating gain OR loss? (box 95), if no; Continue to circulate until hydrate formation temperature in wellhead and marine drilling riser, is above hydrate formation temperature $T_{Hyd}$ (box 96). If the dynamic flow check (box 94) indicates gain OR loss (box 95), these signals must not be ignored. Hydrates may form when the gas mixes with the colder fluids in the upper part of the wellbore, so even if the flow check or shut-in pressure test (box 97), apparently shows normal values (box 98), it is important that circulation is continued (box 94), until temperature is above hydrate formation temperature $T_{Hyd}$ (box 96) and "bottoms-up" has been circulated out. Any abnormal pressure, increase or decrease after shut-in pressure test (box 98), is a strong indication that the well is taking a kick (box 99).

In the open wellbore deep down in the earth formation 22 it is not usual to have low temperature below the hydrate formation temperature $T_{Hyd}$ (box 70), because of the general high formation temperature. However, since pressure also generally increase with depth, the hydrate formation temperature $T_{Hyd}$ can be above 30° C., so with high mud circulation the annulus fluid might not get time to heat up enough to get above these temperatures (box 71). To drill ahead with permanent temperature below the hydrate formation temperature $T_{Hyd}$ deep down in the well should be avoided (details in boxes 73, 75, 78, 77, 79, 82, 82 and 84).

Even more likely is it that the temperature deep down in the well drops below the hydrate formation temperature $T_{Hyd}$ due to cold fluid from the riser area after tripping, being pumped down or in the case of mud cap drilling where large amount of relative cold sacrificial fluid(s) is/are pumped down both in the annulus and drill string in large quantities (box 72). These are more temporary events and prior to drilling ahead it is important that "bottoms up" operation(s), while performing dynamic flow check is/are carried out, to check for any abnormalities (box 74).

Figure 5:
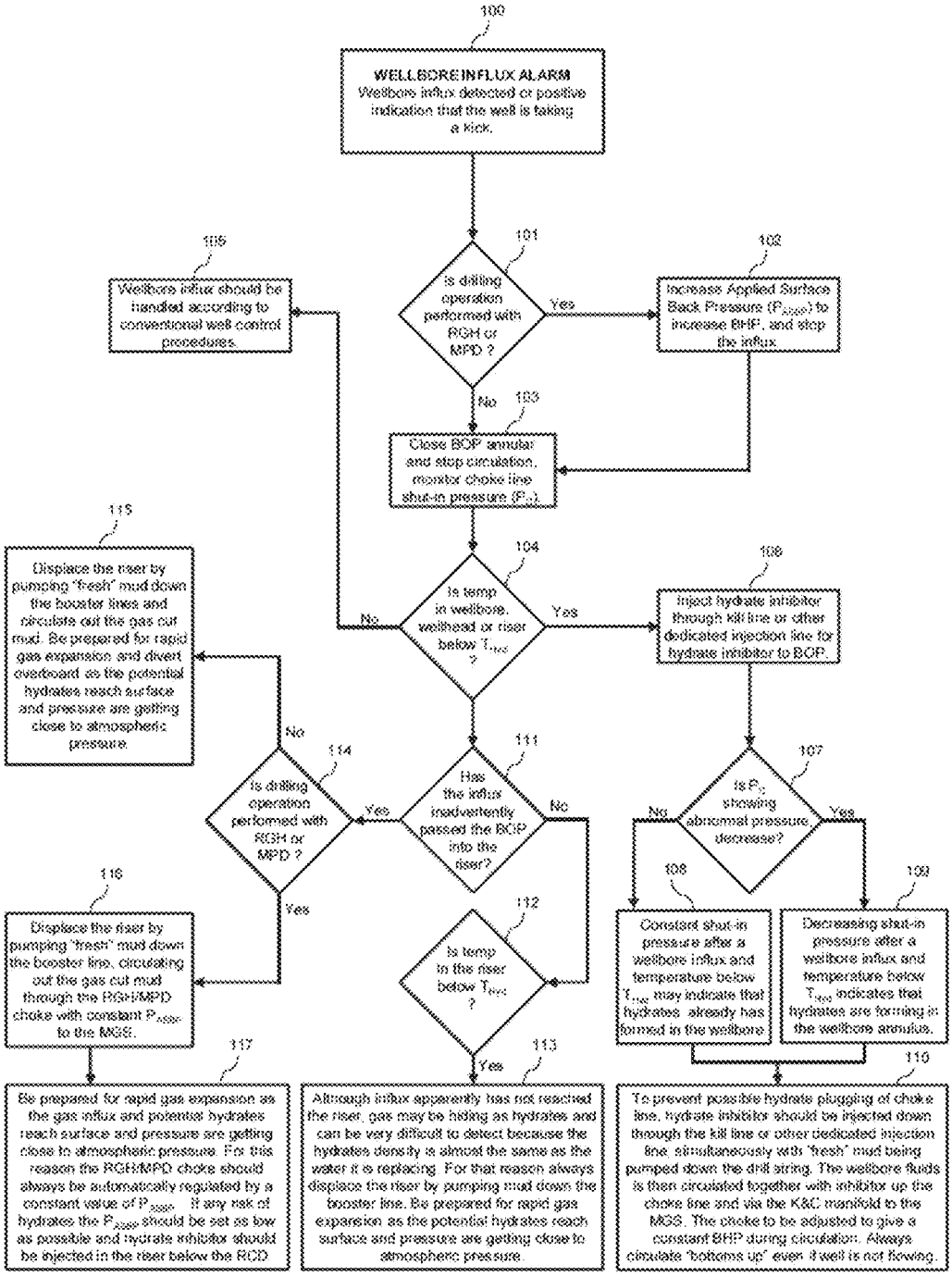
FIG. 5 discloses schematically a method for determine the correct remedial action to be taken based on a wellbore influx alarm.

FIG. 5 shows schematically a method for determine the correct remedial action to be taken after a kick is detected (box 100). If managed pressure drilling (MPD) or riser gas handling (RGH) equipment is installed (box 101), it is important that applied surface back pressure $P_{ASBP}$ to increase bottom hole pressure BHP and stop the influx, is activated as quickly as possible (box 102). After the blow out preventer BOP is closed (box 103), it is important that hydrate inhibitor is injected immediately into the wellhead (box 106), if the temperature in wellbore, wellhead or riser is below the hydrate formation temperature $T_{Hyd}$ (box 104). There is also a special concern that hydrates may form. In such cases the actions identified in boxes 107, 108, 109 and 110 should be followed.

If the influx already has past the BOP (box 111), the riser gas needs to be handled depending on the available equipment topside (compare boxes 114, 115, 116 and 117). Even if there is no sign for gas in riser, special consideration should be taken if the annulus temperature in the riser is below the hydrate formation temperature $T_{Hyd}$, (see boxes 112 and 113 for details).

Figure 6:
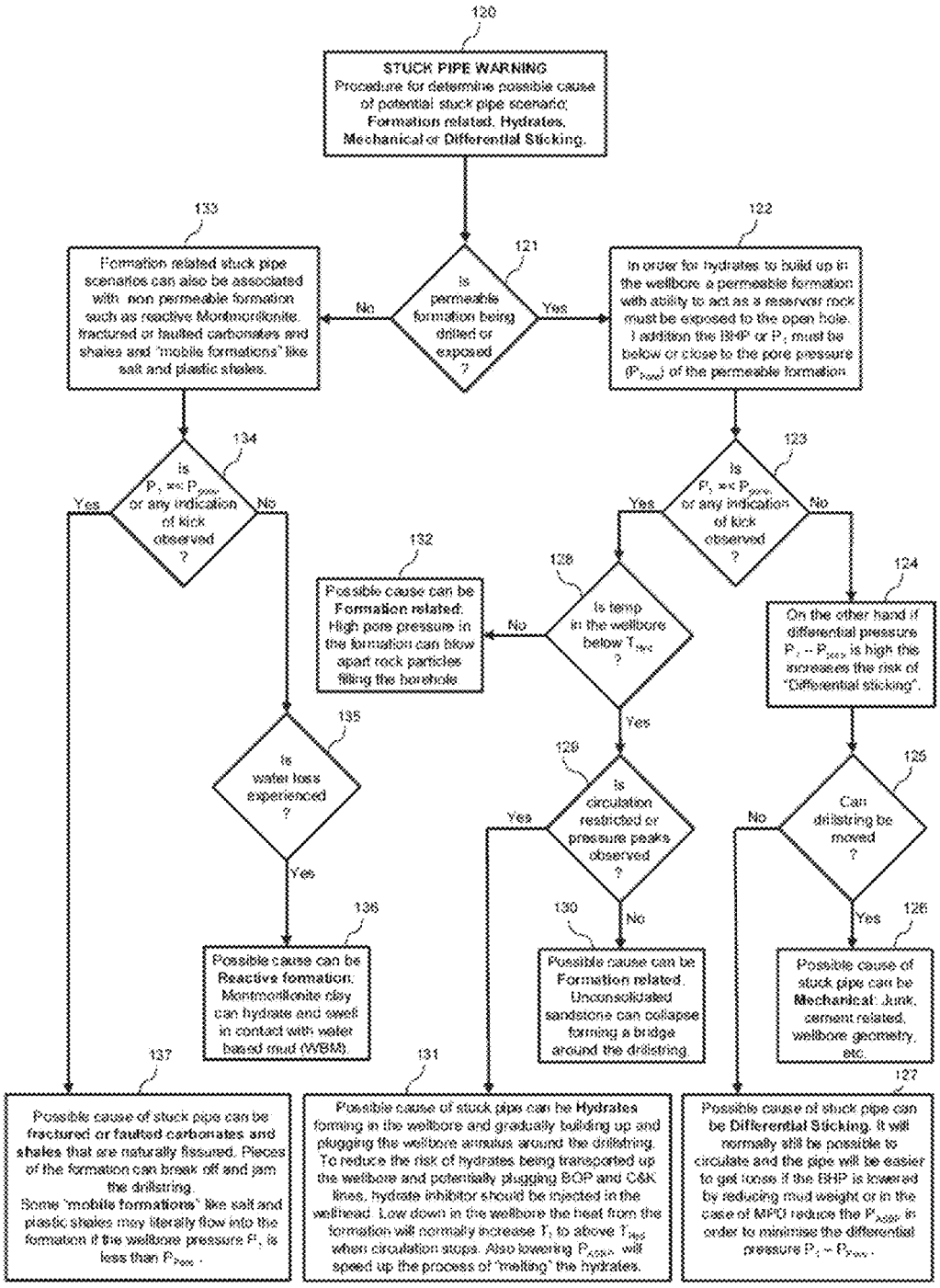
FIG. 6 discloses schematically a method according to the present invention for determining the correct remedial action to be taken based on stuck pipe warning.

FIG. 6 discloses schematically a method for determining the correct remedial action to be taken based on stuck pipe warning. The novel part of this decision diagram is that it introduces hydrate plugging as a possible cause for stuck pipe (box 120). If permeable formation are being drilled or exposed (boxes 121 and 122), indication of a kick is observed (box 123), temperature in the wellbore is below $T_{Hyd}$ (box 128), circulation restricted or pressure peaks observed (box 129), then this is a strong indication that hydrates may are about to create a stuck pipe event (box 131).

Further measurements and/or steps regarding the stuck pipe warning are apparent from FIG. 6.

The present invention has been described in non-limiting embodiments. It is clear that the person skilled in the art may make a number of alterations and modifications to the described embodiments without diverging from the scope of the present invention as defined in the attached claims.

The invention claimed is:

1. A method for detecting an influx in a wellbore with at least one first pressure transmitter arranged in a first position in a well and at least one second pressure transmitter arranged in a second position in the well, the at least one first pressure transmitter and the at least one second pressure transmitter being arranged in a fixed vertical distance in relation to each other, the method comprising:

calculating an expected density of a return flow between the at least one first pressure transmitter and the at least one second pressure transmitter by measuring or predicting a mud or sacrificial fluids density, a rock density, a first flow rate, a true vertical depth, a rate of penetration, and a wellbore diameter;

continuously measuring an actual density of the return flow based on a measured pressure at each of the at least one first pressure transmitter and the at least one second pressure transmitter, the actual density being computed based on the fixed vertical distance between the at least one first pressure transmitter and the at least one second pressure transmitter as adjusted for a frictional pressure drop between each of the at least one first pressure transmitter and the at least one second pressure transmitter based on a direction and a second flow rate in an annulus in the wellbore;

comparing the calculated expected density of the return flow and the measured actual density of the return flow to determine the influx in the wellbore;

predicting a probability of hydrates forming in the well by, using at least one first temperature transmitter arranged in a section of the well adjacent to the at least one first pressure transmitter and/or adjacent to the at least one second pressure transmitter, measuring a temperature at the at least one first temperature transmitter, and using the temperature together with the measurements from the at least one first pressure transmitter and the at least one second pressure transmitter;

confirming a possible hydrate formation; and generating a warning if a temperature reading is below a predefined safety margin of a corresponding hydrate formation temperature.

2. The method as recited in claim 1, wherein the at least one first pressure transmitter and the at least one second pressure transmitter are arranged in an open-hole section of the well.

3. The method as recited in claim 1, wherein the at least one first temperature transmitter is arranged in an open-hole section of the well.

4. The method as recited in claim 1, further comprising:

providing a plurality of pressure transmitters in a fixed vertical distance in the well; and repeating the calculating, continuously measuring and comparing steps of claim 1 between two adjacent pressure transmitters of the plurality of pressure transmitters.

5. The method as recited in claims 1, further comprising:

confirming a wellbore influx if the measured actual density of the return flow is significantly less than the calculated expected density of the return flow.

6. The method as recited in claim 5, further comprising:

monitoring a possible rapid gas expansion in the well;

automatically regulating a riser gas handling or a managed pressure drilling choke by applying a constant value of an applied surface back pressure; and, if a high risk of hydrates is determined, reducing the applied surface back pressure; and injecting a hydrate inhibitor below a rotating control device.

7. The method as recited in claim 5, further comprising:

displacing fluids in a riser if a temperature in the riser is below a hydrate formation temperature;

pumping fresh mud down at least one booster line so as to circulate out gas cut mud;

monitoring a possible rapid gas expansion under consideration that hydrates "melt" at low pressure; and preparing to divert overboard so as to avoid a riser blow-out on a drill floor.

8. The method as recited in 5, further comprising, in case the influx in the wellbore has passed a subsea blowout preventer:

pumping mud down at least one booster line so as to circulate out gas cut mud;

monitoring a possible rapid gas expansion; and preparing to divert overboard so as to avoid a riser blow-out on a drill floor.

9. The method as recited in claim 5, further comprising:

providing a temperature transmitter adjacent to each of the at least one first pressure transmitter and the at least one second pressure transmitter in the well;

predicting a probability of hydrates forming in the well using temperature readings from each temperature transmitter together with the measurements from the at least one first pressure transmitter and the at least one second pressure transmitter.

10. The method as recited in claim 1, further comprising:
filling at least one kill line with a hydrate inhibitor fluid;
injecting the hydrate inhibitor fluid in the at least one kill line in a blow out preventer; and, simultaneously therewith,
pumping fresh mud down a drill string so as to circulate out wellbore fluids and an inhibitor up at least one choke line and to divert to a mud gas separator.

11. The method as recited in claim 1, further comprising:
determining whether a choke line shut-in pressure is showing an abnormal pressure decrease; and
generating a wellbore influx and hydrate alarm.

12. The method as recited in claim 11, further comprising:
identifying a stuck pipe situation as a possible result of hydrate formation by,
observing an increased drag trend or torque oscillation during connections and/or an abnormal pressure increase or a pressure oscillation during circulation, and
confirming that all of the following conditions are fulfilled:
drilling in a permeable formation which has been identified to have an ability to act as a reservoir rock as well as having a pressure close to or higher than a bottom hole pressure or a measured pressure at a pressure transmitter in the well,
observing that the temperature in the wellbore is below a hydrate formation temperature, and
observing a circulation restriction or a pressure peak.

13. The method as recited in claim 12, wherein, in case of the stuck pipe situation caused by hydrate formation, the method further comprises:
injecting hydrate inhibitor fluid close to a wellhead,
stopping a circulation so as to allow a temperature in a formation to increase a temperature of fluids in the well so as to perfom a hydrate dissociation process comprising melting or dissociating the hydrates into water and dense gas;
performing a flow check to verify that the hydrate dissociation process has started;
shutting-in the well if the well starts to flow; and
monitoring a shut-in pressure increase to determine a size of a hydrate plug/kick.

14. A method for detecting an influx in a wellbore with at least one first pressure transmitter arranged in a first position in a well and at least one second pressure transmitter arranged in a second position in the well, the at least one first pressure transmitter and the at least one second pressure transmitter being arranged in a fixed vertical distance in relation to each other, the method comprising:
calculating an expected density of a return flow between the at least one first pressure transmitter and the at least one second pressure transmitter by measuring or predicting a mud or sacrificial fluids density, a rock density, a first flow rate, a true vertical depth, a rate of penetration, and a wellbore diameter;
continuously measuring an actual density of the return flow based on a measured pressure at each of the at least one first pressure transmitter and the at least one second pressure transmitter, the actual density being computed based on the fixed vertical distance between the at least one first pressure transmitter and the at least one second pressure transmitter as adjusted for a frictional pressure drop between each of the at least one first pressure transmitter and the at least one second pressure transmitter based on a direction and a second flow rate in an annulus in the wellbore;
comparing the calculated expected density of the return flow and the measured actual density of the return flow to determine the influx in the wellbore;
predicting a probability of hydrates forming in the well by,
using at least one first temperature transmitter arranged in a section of the well adjacent to the at least one first pressure transmitter and/or adjacent to the at least one second pressure transmitter,
measuring a temperature at the at least one first temperature transmitter, and
using the temperature together with the measurements from the at least one first pressure transmitter and the at least one second pressure transmitter;
monitoring a possible rapid gas expansion in the well;
automatically regulating a riser gas handling or a managed pressure drilling choke by applying a constant value of an applied surface back pressure; and, if a high risk of hydrates is determined;
reducing the applied surface back pressure; and
injecting a hydrate inhibitor below a rotating control device.

15. The method as recited in claim 14, further comprising:
providing a plurality of pressure transmitters in a fixed vertical distance in the well; and
repeating the calculating, continuously measuring and comparing steps of claim 14 between two adjacent pressure transmitters of the plurality of pressure transmitters.

16. The method as recited in claims 14, further comprising:
confirming a wellbore influx if the measured actual density of the return flow is significantly less than the calculated expected density of the return flow.

17. The method as recited in claim 14, further comprising:
displacing fluids in a riser if a temperature in the riser is below a hydrate formation temperature;
pumping fresh mud down at least one booster line so as to circulate out gas cut mud;
monitoring a possible rapid gas expansion under consideration that hydrates "melt" at low pressure; and
preparing to divert overboard so as to avoid a riser blow-out on a drill floor.

18. A method for detecting an influx in a wellbore with at least one first pressure transmitter arranged in a first position in a well and at least one second pressure transmitter arranged in a second position in the well, the at least one first pressure transmitter and the at least one second pressure transmitter being arranged in a fixed vertical distance in relation to each other, the method comprising:
calculating an expected density of a return flow between the at least one first pressure transmitter and the at least one second pressure transmitter by measuring or predicting a mud or sacrificial fluids density, a rock density, a first flow rate, a true vertical depth, a rate of penetration, and a wellbore diameter;
continuously measuring an actual density of the return flow based on a measured pressure at each of the at least one first pressure transmitter and the at least one second pressure transmitter, the actual density being computed based on the fixed vertical distance between the at least one first pressure transmitter and the at least one second pressure transmitter as adjusted for a frictional pressure drop between each of the at least one first pressure transmitter and the at least one second pressure transmitter based on a direction and a second flow rate in an annulus in the wellbore;

comparing the calculated expected density of the return flow and the measured actual density of the return flow to determine the influx in the wellbore; and predicting a probability of hydrates forming in the well by, using at least one first temperature transmitter arranged in a section of the well adjacent to the at least one first pressure transmitter and/or adjacent to the at least one second pressure transmitter, measuring a temperature at the at least one first temperature transmitter, and using the temperature together with the measurements from the at least one first pressure transmitter and the at least one second pressure transmitter;

displacing fluids in a riser if a temperature in the riser is below a hydrate formation temperature;

pumping fresh mud down at least one booster line so as to circulate out gas cut mud;

monitoring a possible rapid gas expansion under consideration that hydrates "melt" at low pressure; and preparing to divert overboard so as to avoid a riser blow-out on a drill floor.

19. The method as recited in claim 18, further comprising:

providing a plurality of pressure transmitters in a fixed vertical distance in the well; and repeating the calculating, continuously measuring and comparing steps of claim 18 between two adjacent pressure transmitters of the plurality of pressure transmitters.

20. The method as recited in claims 18, further comprising:

confirming a wellbore influx if the measured actual density of the return flow is significantly less than the calculated expected density of the return flow.

21. The method as recited in claim 18, further comprising:

confirming a possible hydrate formation; and generating a warning if a temperature reading is below a predefined safety margin of a corresponding hydrate formation temperature.

* * * * *